US008491724B2

(12) United States Patent
Beer et al.

(10) Patent No.: US 8,491,724 B2
(45) Date of Patent: Jul. 23, 2013

(54) DISHWASHER CONTROL FOR DEALING WITH LARGE AMOUNTS OF FOOD RESIDUES BY VARIABLE WASH PROGRAMS

(75) Inventors: Hans Beer, Medlingen (DE); Rüdiger Eiermann, Syrgenstein (DE); Claus Köther, Niederstotzingen (DE); Roland Rieger, Rainau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2055 days.

(21) Appl. No.: 10/583,621

(22) PCT Filed: Dec. 8, 2004

(86) PCT No.: PCT/EP2004/053345

§ 371 (c)(1),
(2), (4) Date: Mar. 26, 2007

(87) PCT Pub. No.: WO2005/060812

PCT Pub. Date: Jul. 7, 2005

(65) Prior Publication Data

US 2007/0181154 A1 Aug. 9, 2007

(30) Foreign Application Priority Data

Dec. 22, 2003 (DE) ..... 103 60 552

(51) Int. Cl.
*B08B 9/20* (2006.01)

(52) U.S. Cl.
USPC ..... 134/25.2; 134/18; 134/25.3

(58) Field of Classification Search
USPC ..... 134/18, 25.2, 25.3, 56 R, 56 D, 57 D, 134/58 D, 94.1, 113, 172, 178
See application file for complete search history.

(56) References Cited

U.S. PATENT DOCUMENTS

| | | | | |
|---|---|---|---|---|
| 3,451,400 | A | 6/1969 | Cushing | |
| 5,017,852 | A | 5/1991 | Nagata et al. | |
| 5,355,900 | A * | 10/1994 | Sakata | 134/95.2 |
| 5,849,101 | A * | 12/1998 | Edwards et al. | 134/18 |
| 2001/0017145 | A1 | 8/2001 | Rosenbauer et al. | |
| 2002/0108639 | A1* | 8/2002 | Eiermann et al. | 134/18 |

FOREIGN PATENT DOCUMENTS

| | | | |
|---|---|---|---|
| DE | 2441361 | * | 3/1976 |
| DE | 28 48 375 | | 5/1980 |
| DE | 31 13 443 | | 10/1982 |

(Continued)

OTHER PUBLICATIONS

International Search Report PCT/EP2004/053345.

*Primary Examiner* — Saeed T Chaudhry
(74) *Attorney, Agent, or Firm* — James E. Howard; Andre Pallapies

(57) ABSTRACT

A method is provided enabling a dishwasher to be operated with variable wash programs, wherein the filter systems of the dishwasher do not become overloaded with protruding wash residues in the rinsing fluid. The method makes it possible to vary the pressure used to convey the rinsing fluid from the circulating pump to the at least one spray device. The advantage thereof is that protruding wash residues in the rinsing liquid can be reduced or flattened in order to prevent the filter systems in the dishwasher from becoming overloaded so that the cleaning effects of the filter system can remain functional.

2 Claims, 2 Drawing Sheets

FOREIGN PATENT DOCUMENTS

| | | | |
|---|---|---|---|
| DE | 196 51 347 | | 6/1998 |
| DE | 197 50 266 | | 5/1999 |
| DE | 199 07 158 | | 8/2000 |
| DE | 199 51 839 | | 5/2001 |
| DE | 101 54 630 | | 5/2003 |
| EP | 0 553 803 | | 8/1993 |
| EP | 0 998 872 | | 5/2000 |
| EP | 1 031 314 | | 8/2000 |
| EP | 1 332 709 | | 8/2003 |
| EP | 1 362 547 | | 11/2003 |
| GB | 1 522 153 | | 8/1978 |
| GB | 2 221 384 | | 2/1990 |
| GB | 2221384 | * | 3/1990 |

* cited by examiner

DISHWASHER CONTROL FOR DEALING WITH LARGE AMOUNTS OF FOOD RESIDUES BY VARIABLE WASH PROGRAMS

BACKGROUND OF THE INVENTION

The invention relates to a method for operating a dishwasher comprising at least one washing container, wherein a washing fluid is conveyed by means of a circulating pump to at least one spray device for acting upon items to be cleaned, which are located in the washing container, and comprising a wash program at least composed of the partial program steps pre-wash, clean, intermediate rinse, clear rinse and dry. The invention is further directed towards a dishwasher wherein a method with a variable wash program is provided for application.

Dishwashers usually have at least one washing container and spray devices located therein, wherein the spray devices are loaded with liquid conveyed by a circulating pump in order to act upon items to be washed in the washing container with washing fluid. In the known dishwashers, wash programs composed of the partial program steps pre-wash, clean, intermediate rinse, clear rinse and dry can usually be selected by means of a program controller. Since the washing fluid accumulates washing residues during the wash phases, filter systems are provided in the water circuit of the dishwasher through which washing water circulated by the circulating pump is passed continuously.

The known dishwashers have the disadvantage that the water jet acting on the items to be washed through the spray devices is relatively strong and thus food residues are released relatively rapidly during the pre-wash phase. There is thus a risk that the washing residues cannot be removed in good time or to the required extent and the filter systems provided in the dishwasher become clogged with washing residues, which impedes the water circulation in the dishwasher. This results in back-contamination of the items to be washed as a result of size reduction and fine distribution of the washing residues deposited at the filter systems and thus reduces the cleaning effect of the dishwasher.

It is thus the object of the present invention to provide a method whereby a dishwasher with a variable wash program can be operated such that the appearance of washing residues in the washing liquid is less concentrated or distributed over a longer time interval so that the filter systems in the dishwasher are not overloaded.

SUMMARY OF THE INVENTION

The present invention proposes a method for operating a dishwasher comprising at least one washing container, wherein a washing fluid is conveyed by means of a circulating pump to at least one spray device for acting upon items to be cleaned, which are located in the washing container, and comprising a wash program at least composed of the partial program steps pre-wash, clean, intermediate rinse, clear rinse and dry, wherein the pressure at which the washing liquid is conveyed from the circulating pump to the at least one spray device can be varied in order to remove food residues in small quantities by a pre-determined hydraulic abrasion capacity, e.g. spray pressure and spray quantity and carry them away from the dishwasher, thus ensuring that the filter remains functional for the remainder of the wash program.

The method according to the invention makes it possible to reduce the intensity of the water jet acting on the items to be washed by means of the spray devices, for example, during the pre-wash phase or at the beginning of the main cleaning phase where experience shows that the occurrence of washing residues released from the items to be washed is particularly high. In this way, the release of food residues can be distributed over a longer time interval especially during the pre-wash phase. This has the result that the peak occurrence of washing residues in the washing liquid is reduced or flattened so that the filter systems in the dishwasher are not overloaded and the cleaning effects are sufficient to preserve the functionality of the filter systems. This avoids back-contamination of the items to be washed as a result of size reduction and fine distribution of the washing residues deposited at the filter systems and preserves the cleaning effect of the dishwasher. It is thus unnecessary to adapt the filter systems in the dishwasher for items having a particularly high degree of contamination.

In a preferred embodiment of the present invention, the speed and therefore the capacity of the circulating pump for conveying washing liquid can be varied. For this purpose, the electrical circulating pump is supplied with a driving current of different power so that the circulating pump produces correspondingly different speeds. This has the consequence that the circulating pump conveys different quantities of washing liquid to the spray device and thus the intensity of the water jet acting on the items to be washed can be varied by the spray devices.

With this preferred embodiment of the method according to the invention, the circulating pump can be operated at a lower speed at the beginning of the pre-wash phase for example so that the water jet acting on the items to be washed through the spray device is less intensive. As a result, the release of food residues from the items to be washed is distributed over a longer time, especially during the pre-wash phase since the peak occurrence of washing residues in the washing liquid is reduced or flattened so that the filter systems in the dishwasher are not overloaded. The generation of a lower-intensity water jet acting on the items to be washed can also be desirable during the clear rinsing process since the items to be washed should only be wetted with clear rinsing agent in this case.

A similar effect can be achieved if the circulating pump is operated at least intermittently when the washing liquid used for a washing process, especially the pre-wash process or the clear rinse process, is admitted into the dishwasher. During the admission of washing liquid into the dishwasher, the washing liquid required for a washing process is not yet completely introduced into the dishwasher, which means that the liquid level of the washing liquid is still at a low level. This has the result that during admission of the washing liquid into the dishwasher, in addition to the washing liquid the circulating pump also draws in air in part and in particular conveys a smaller volume of washing liquid than that conveyed when the liquid level of the washing liquid in the dishwasher is at a higher or maximum level. The reduced conveying capacity of the circulating pump again has the consequence that the water jet acting on the items to be washed through the spray device is less intensive and the release of food residues from the items to be washed is distributed over a longer time, whereby peak occurrences of washing residues in the washing liquid are reduced or flattened.

Further, according to another preferred embodiment of the present invention, a method is provided whereby the quantity of washing liquid introduced into the dishwasher, especially the pre-wash process or the clear rinse process, is only a part of the total washing liquid which can be received by the dishwasher. By this means, the washing liquid required for a washing process is not completely introduced into the dishwasher, which means that the liquid level of the washing liquid is at a low level during the entire relevant washing process. This has the result that during the entire relevant washing process, in addition to the washing liquid the circulating pump also draws in air in part and in particular conveys a smaller volume of washing liquid than that conveyed when the liquid level of the washing liquid in the dishwasher is at a higher or maximum level.

In this way, the circulating pump can be operated at a lower conveying capacity, especially during the pre-wash process or the clear rinse process whereby the effects described above can be achieved. This operating mode wherein the circulating pump also draws in some air in addition to the washing liquid, can also result in pulsed behaviour of the water jet or water pressure produced by the circulating pump and the spray device, which also results in the desired effect that the water jet acting on the items to be washed is less intensive and the release of food residues from the items to be washed is distributed over a longer time, whereby peak occurrences of washing residues in the washing liquid are reduced or flattened.

In the method according to the invention, it can be provided that the quantity of washing liquid used for a washing process, especially the pre-wash process or the clear-rinse process is varied during the relevant washing process. As a result of the effect described above that when the liquid level in the dishwasher is low, the circulating pump also draws in some air in addition to the washing liquid and consequently conveys a smaller volume of washing liquid, the conveying capacity of the circulating pump and therefore the intensity of the water jet produced by the circulating pump via the spray devices can be varied in a simple manner by varying the washing liquid level in the dishwasher.

The washing liquid level in the dishwasher can be varied, for example, by supplying fresh water which increases the washing liquid level. A lye pump for pumping away washing liquid from the dishwasher is preferably operated at least intermittently during a washing process, especially during the pre-wash process to reduce the washing liquid level.

According to a further preferred embodiment of the method according to the invention, the lye pump and the circulating pump are operated alternately one after the other. This is preferably carried out in the end region of pumping away the washing solution from the washing container by the lye pump, a small quantity of washing solution still being present. The filters in the area of the sump can thereby be cleaned and food residue can thereby be removed from the washing container.

It has been found that peak occurrences of washing residues in the washing liquid can be processed particularly efficiently by the dishwasher without impairing the cleaning effect if the quantity of washing liquid present in the dishwasher for a washing process, especially the pre-wash process or the clear rinse process, in a first part section of the relevant washing process is between about 30% and 60% of the total washing liquid which can be received by the dishwasher, in a second part section of the relevant washing process the quantity of washing liquid present in the dishwasher is between about 50% and 100% of the total washing liquid which can be received by the dishwasher, and in a third part section of the relevant washing process the quantity of washing liquid present in the dishwasher is between about 30% and 60% of the total washing liquid which can be received by the dishwasher.

Advantageously, after each part program step using washing liquid, the washing liquid is substantially completely exchanged to enhance the cleaning effect. A particularly good washing result can be achieved if the washing liquid used for a washing process, especially the pre-wash process, is preferably completely exchanged at least once during the washing process.

BRIEF DESCRIPTION OF THE DRAWINGS

The invention is explained in detail hereinafter using a preferred exemplary embodiment with reference to the appended drawings. In the figures.

DETAILED DESCRIPTION OF THE INVENTION

Figure 1:
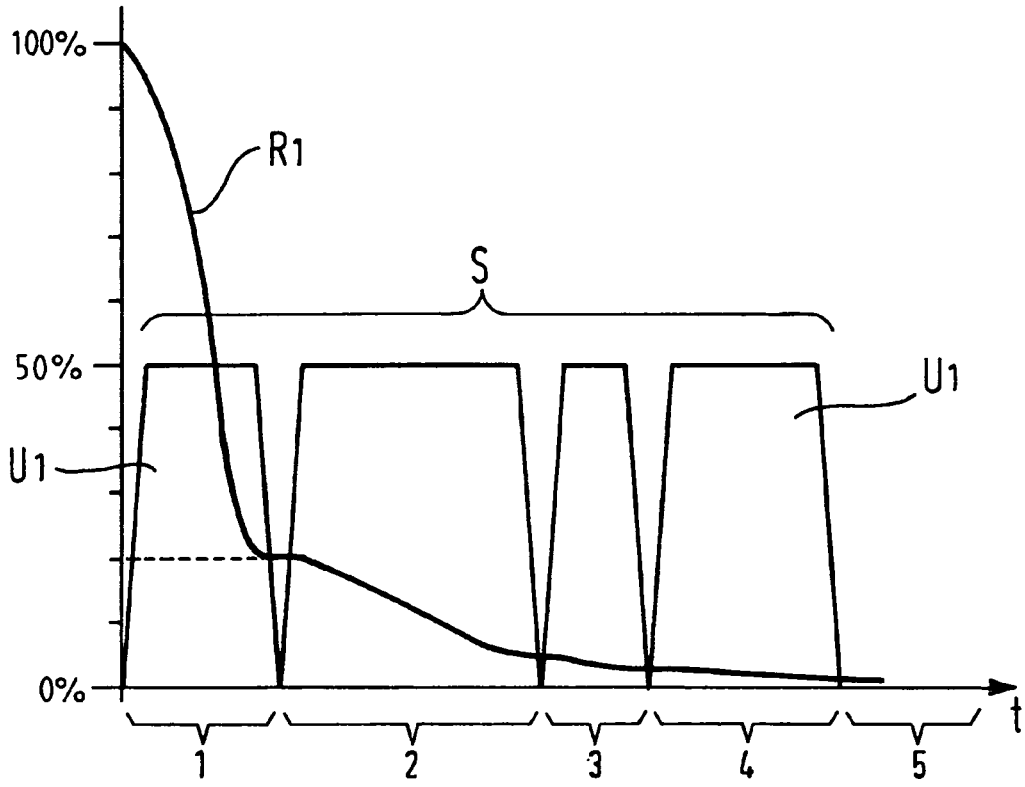
FIG. 1 is a diagram showing the operation of the circulating pump and the occurrence of washing residues in the washing liquid in a washing program of a dishwasher according to the prior art.

FIG. 1 is a diagram showing the operation of the circulating pump and the occurrence of washing residues in the washing liquid in a washing program S of a dishwasher according to the prior art. In the diagram in FIG. 1, the time t is plotted on the X axis and the intensity of the occurrence of washing residues in the washing liquid from 0% to 100% is plotted on the Y axis. The diagram further contains a curve $U_1$ to show the operation or the capacity of the circulating pump in a dishwasher according to the prior art. The percentages plotted on the Y axis do not relate to the capacity of the circulating pump but merely to the intensity of the occurrence of washing residues in the washing liquid.

As can be seen from FIG. 1, the method or washing program S for operating a dishwasher according to the prior art is composed of a plurality of part program steps: pre-wash 1, clean 2, intermediate rinse 3, clear rinse 4 and dry 5. The dishwasher comprises a circulating pump which conveys a washing liquid to a spray device for acting upon items to be washed which are located in the washing container. During the part program steps 1, 2, 3, 4 using washing liquid, the circulating pump according to the prior art is always operated at full or at least the same capacity $U_1$.

The known dishwashers have the disadvantage that the action of the water jet on the items to be washed by the spray device takes place at maximum intensity so that the release of food residues especially during the pre-wash phase is relatively intensive. This can be seen in FIG. 1 from the very steeply descending curve $R_1$ beginning at 100% which gives the intensity of the occurrence of washing residues in the washing liquid. As a result, in the pre-wash phase alone up to 80% of the total washing residues can accumulate and especially at the beginning of the pre-wash phase there is a risk that the washing residues cannot be removed in good time or to the required extent. The filter systems provided in the dishwasher become clogged with washing residues, which impedes the water circulation in the dishwasher. This can result in back-contamination of the items to be washed as a result of size reduction and fine distribution of the washing residues deposited at the filter systems and thus reduces the cleaning effect of the dishwasher.

Figure 2:
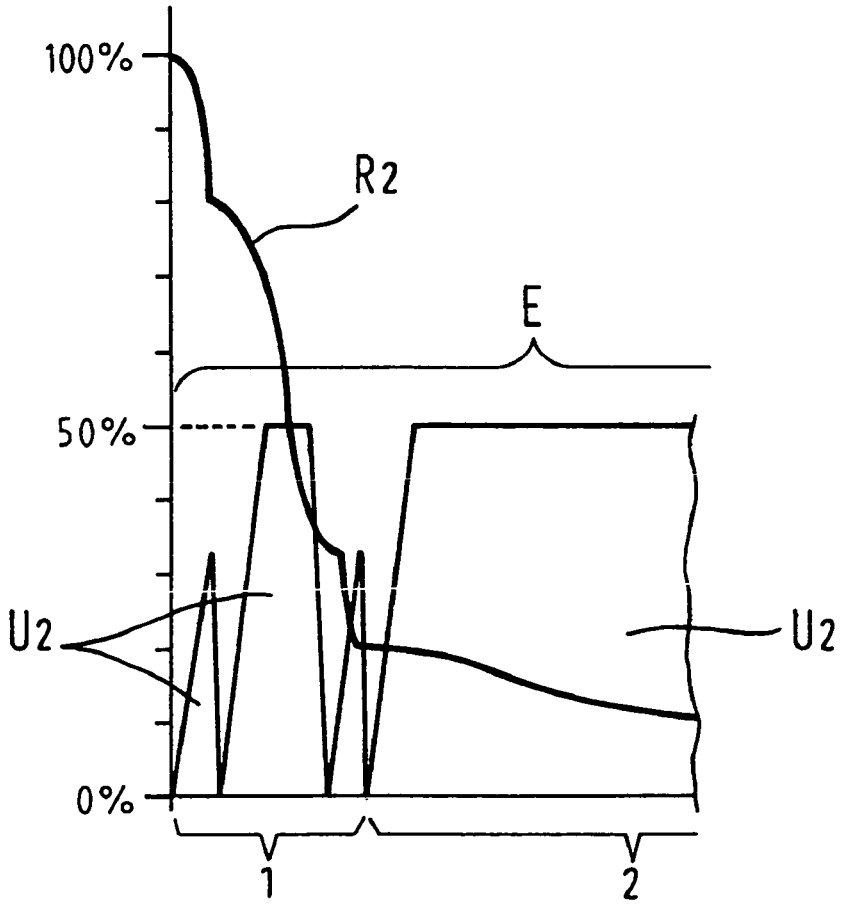
FIG. 2 is a diagram showing the operation of the circulating pump and the occurrence of washing residues in the washing liquid in a method for operating a dishwasher according to the present invention according to a preferred embodiment.

FIG. 2 is a diagram showing the operation of the circulating pump and the occurrence of washing residues in the washing liquid in a washing program E in a preferred embodiment of the method for operating a dishwasher according to the present invention. In the diagram in FIG. 2, as in FIG. 1, the time t is plotted on the X axis and the intensity of the occurrence of washing residues in the washing liquid from 0% to 100% is plotted on the Y axis. The diagram in FIG. 2 further contains a curve $U_2$ to show the operation or the capacity of the circulating pump in a washing program E of a dishwasher according to a preferred embodiment of the present invention. The percentages plotted on the Y axis do not relate to the capacity of the circulating pump but merely to the intensity of the occurrence of washing residues in the washing liquid.

As can be seen from FIG. 2, the method for operating a dishwasher according to a preferred embodiment of the invention begins with the part program steps pre-wash 1 and clean 2; other part program steps such as intermediate rinse 3, clear rinse 4 and dry 5, can follow. The dishwasher comprises a circulating pump which conveys a washing liquid to a spray device for acting upon items to be washed which are located in the washing container. During the pre-wash phase 1, the circulating pump is operated at variable capacity U. For this purpose the circulating pump is operated at less than maximum capacity especially at the beginning of the pre-wash phase 1.

In the washing program E according to the invention shown in FIG. 2, the circulating pump is operated at about 50% capacity in a first part section of the pre-wash phase 1, it is operated at about 100% capacity in a second part section of the pre-wash phase 1 and is again operated at about 50% maximum capacity in a third part section of the pre-wash phase 1. This operating mode of the circulating pump has the consequence that the washing residues are gradually removed from the items to be washed and thus peak occurrences of washing residues in the washing liquid are reduced or flattened.

The method according to the invention for operating dishwashers thus has the advantage that the action of the water jet on the items to be washed by the spray device does not always take place at maximum intensity but at reduced and variable intensity. This can be deduced in FIG. 2 from the more gently descending curve $R_2$ compared with FIG. 1, giving the intensity of the occurrence of washing residues in the washing liquid. This has the advantage that the peak occurrence of washing residues in the washing liquid, especially during the pre-wash phase, are stretched over a longer time interval so that the filter systems in the dishwasher are not overloaded and the cleaning effects are sufficient to preserve the functionality of the filter systems.

REFERENCE LIST

1 Pre-wash part program step
2 Clean part program step
3 Intermediate rinse part program step
4 Clear rinse part program step
5 Dry part program step
S Wash program according to prior art
E Wash program according to invention
$U_1$ Operation or capacity of circulating pump in a method according to the prior art
$U_2$ Operation or capacity of circulating pump in a method according to the present invention
$R_1$ Curve to show the occurrence of washing residues in the washing liquid according to the prior art
$R_2$ Curve to show the occurrence of washing residues in the washing liquid according to the present invention.

The invention claimed is:

1. A method for operating a dishwasher comprising at least one washing container, a circulating pump which conveys washing liquid to at least one spray device for acting upon items to be cleaned, which are located in the washing container, and comprising a wash program at least composed of partial program steps pre-wash (1), clean (2), intermediate rinse (3), clear rinse (4) and dry (5), the method comprising varying a pressure at which the washing liquid is conveyed from the circulating pump to the at least one spray device in order to remove food residues in small quantities by a predetermined hydraulic abrasion capacity including at least one of spray pressure and spray quantity and carry the food residues away from the dishwasher, thus ensuring that the filter remains functional in a remainder of the wash program; wherein in a first part section of the pre-wash process, the circulating pump is operated at about 30% to 60% of maximum capacity, in a second part section of the pre-wash process it is operated at about 50% to 100% of maximum capacity and in a third part section of the prewash process it is operated at about 30% to 60% of maximum capacity.

2. A method for operating a dishwasher comprising at least one washing container, a circulating pump which conveys washing liquid to at least one spray device for acting upon items to be cleaned, which are located in the washing container, and comprising a wash program at least composed of partial program steps pre-wash (1), clean (2), intermediate rinse (3), clear rinse (4) and dry (5), the method comprising varying a pressure at which the washing liquid is conveyed from the circulating pump to the at least one spray device in order to remove food residues in small quantities by a predetermined hydraulic abrasion capacity including at least one of spray pressure and spray quantity and carry the food residues away from the dishwasher, thus ensuring that the filter remains functional in a remainder of the wash program; wherein the quantity of washing liquid present in the dishwasher for a part program step (1, 2, 3, 4) in a first part section of a relevant part program step (1, 2, 3, 4) is between about 30% and 60% of the total washing liquid which can be received by the dishwasher, in a second part section of the relevant part program step (1, 2, 3, 4) the quantity of washing liquid present in the dishwasher is between about 50% and 100% of the total washing liquid which can be received by the dishwasher, and in a third part section of the relevant part program step (1, 2, 3, 4) the quantity of washing liquid present in the dishwasher is between about 30% and 60% of the total washing liquid which can be received by the dishwasher.

* * * * *

UNITED STATES PATENT AND TRADEMARK OFFICE

CERTIFICATE OF CORRECTION

PATENT NO. : 8,491,724 B2
APPLICATION NO. : 10/583621
DATED : July 23, 2013
INVENTOR(S) : Beer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2116 days.

Signed and Sealed this
Eighth Day of September, 2015

Michelle K. Lee

Michelle K. Lee
*Director of the United States Patent and Trademark Office*